US005086636A

United States Patent [19]

Huet

[11] Patent Number: 5,086,636

[45] Date of Patent: Feb. 11, 1992

[54] STRETCH-FORMING MACHINE

[75] Inventor: Jean-Paul Huet, Nantes, France

[73] Assignee: ACB, Paris, France

[21] Appl. No.: 628,027

[22] Filed: Dec. 17, 1990

[51] Int. Cl.[5] ..... B21D 11/02

[52] U.S. Cl. ..... 72/296

[58] Field of Search ..... 72/297, 296, 301, 295, 72/311

[56] References Cited

U.S. PATENT DOCUMENTS

| | | | |
|---|---|---|---|
| 2,676,638 | 4/1954 | Wheeler | 72/296 |
| 2,676,639 | 4/1954 | Gray | 72/296 |
| 2,759,513 | 8/1956 | Green | 72/297 |
| 3,302,437 | 2/1967 | Dolney | 72/296 |

FOREIGN PATENT DOCUMENTS

| | | | |
|---|---|---|---|
| 1106717 | 12/1955 | France | 72/301 |
| 554908 | 4/1977 | U.S.S.R. | 72/296 |

*Primary Examiner*—Daniel C. Crane

*Attorney, Agent, or Firm*—Sughrue, Mion, Zinn, Macpeak & Seas

[57] ABSTRACT

A stretch-forming machine for forming about a forming die, the machine comprising two jaws situated longitudinally on either side of the die, each jaw being connected to a fixed portion via drive means enabling each end of the jaw to move substantially in a plane perpendicular to the jaw in its rest position and to move in any direction within the plane. The die is fixed on a base connected to a table of a fixed frame, the table being situated at ground level, and the machine includes vertical guide means for the middles of the jaws, the jaws being connected to the drive means without any possibility of rotating relative to the means about a longitudinal axis.

7 Claims, 7 Drawing Sheets

STRETCH-FORMING MACHINE

The present invention relates to a stretch-forming machine.

BACKGROUND OF THE INVENTION

Such machines are used in particular for making covering pieces for certain parts of aircraft: leading edges of wings, fuselage components, wing or fin fillets, cowlings.

Such pieces are made by these machines from plane metal sheet which is clamped at two ends in rectilinear jaws and which is then constrained to take up the shape of a template or forming die by means of traction with the metal sheet deforming plastically.

The die has the exact shape of the piece to be obtained and the idea is therefore to wrap the sheet around the die so as to cause the sheet to take up the shape of the die exactly. This wrapping is performed by traction with the sheet suffering plastic deformation, thereby eliminating any return spring effect.

Thus, French patent No. 1 087 985 describes a machine for shaping metal sheet by tension and by winding. That machine includes a pit (11) over which a die (12) is suspended. Each jaw (41) is hinged about a horizontal axis (38) at the end of three pairs of actuators (26, 49). Each pair of actuators lies substantially in a vertical plane and comprises one actuator (26) mounted on a universal joint and capable of oscillating about the horizontal, and a control actuator (49) which is in a position that is vertical or close to vertical and which is hinged at its two ends about two perpendicular axes.

Such a machine is laterally unstable, and in addition since the jaws are hinged about a horizontal axis (38), it cannot wind sheet through more than 180°. The sheet remains permanently in the clamping plane of the jaws and never forms an angle relative to the jaws, and therefore nothing is provided to offer a reaction against the torque to which the jaws are subjected. This disposition does not allow very narrow pieces such as the leading edges of an aircraft wing to be formed. The presence of a pit is dangerous for personnel.

An object of the invention is to provide a forming machine which is safer and which has better performance, enabling a winding angle of 240° to be achieved and therefore enabling very narrow pieces such as the leading edges of aircraft wing to be formed.

SUMMARY OF THE INVENTION

The invention thus provides a stretch-forming machine for forming about a forming die, the machine comprising two jaws situated longitudinally on either side of the die, each jaw being connected to a fixed portion via drive means enabling each end of the jaw to move substantially in a plane perpendicular to the jaw in its rest position and to move in any direction within said plane, wherein said die is fixed on a base connected to a table of a fixed frame, the table being situated at ground level, and wherein the machine includes vertical guide means for the middles of the jaws, said jaws being connected to said drive means without any possibility of rotating relative to said means about a longitudinal axis.

In a first embodiment, said vertical guide means comprise, for each jaw, a strut constituted by a rod fixed to the middle of the jaw by means of a vertical axis hinge and sliding freely, with freedom to rotate, in a tube pivoting at its rear end on the frame about a horizontal axis, and having its front end guided in a vertical plane by a U-shaped guide piece.

In a preferred, second embodiment said vertical guide means are displaceable laterally in the lengthwise direction of the jaws.

In a particular implementation of this second embodiment, said laterally displaceable vertical guide means comprise, for each jaw, a strut constituted by a rod fixed to the middle of the jaw by means of a vertical axis hinge and sliding freely, with freedom to rotate, in a tube whose rear end is fixed to the frame by means of a hinge about two perpendicular axes and whose front end carries a guide nut provided with horizontal side actuators carrying skids which slide over two fixed vertical guide walls.

Advantageously, said drive means comprise, for each jaw and for each end of a jaw, two means for varying the distance between a fixed point of the jaw adjacent to said end and two fixed points of the frame, these two fixed points of the frame being two distinct points situated in the plane that includes said fixed point of the jaw and extends transversely to the jaw when in its first position.

Each jaw may be fitted with a curve-forming tip.

BRIEF DESCRIPTION OF THE DRAWINGS

An embodiment of the invention is described by way of example with reference to the accompanying drawings, in which.

DETAILED DESCRIPTION

Figure 1:
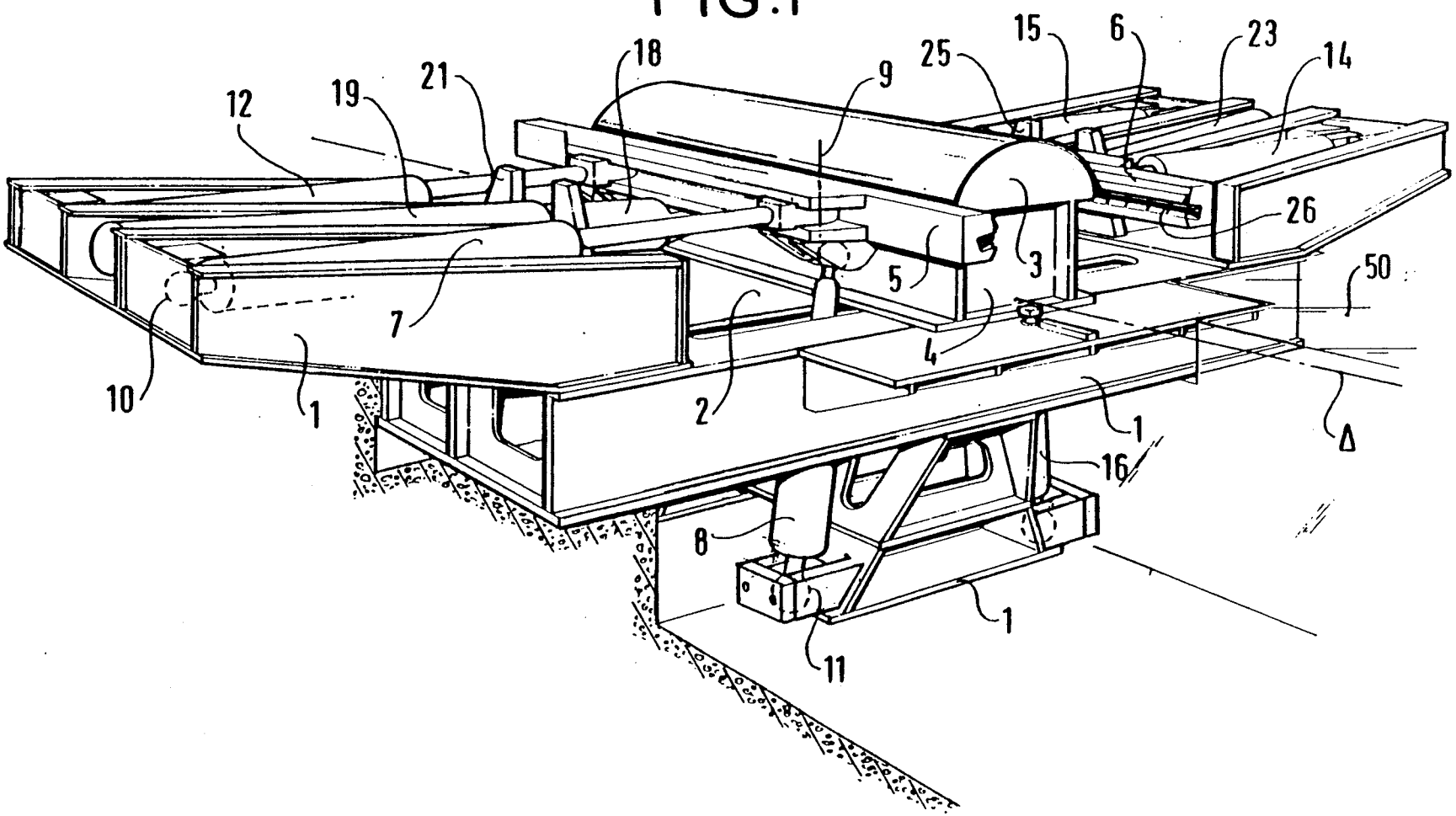
FIG. 1 is a perspective view of a stretch-forming machine of the invention.
Figure 2:
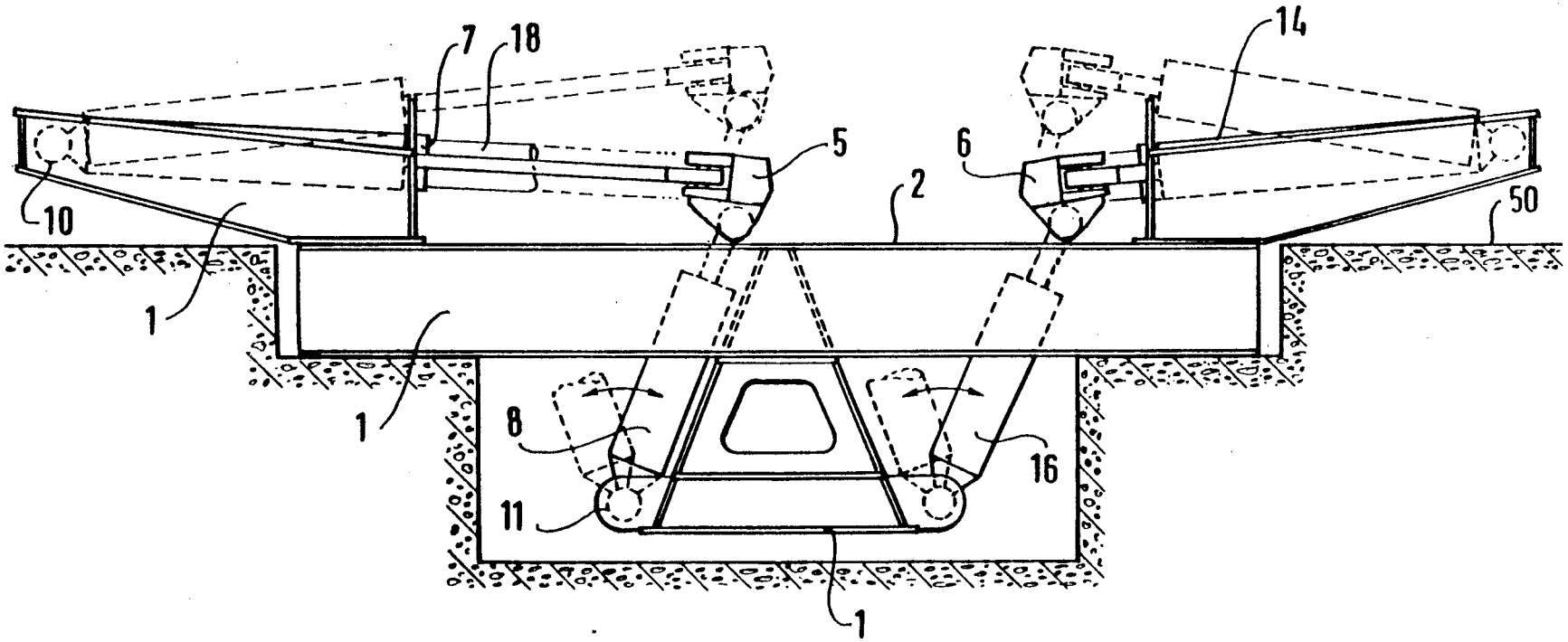
FIGS. 2 to 4 show the stretch-forming machine of FIG. 1 in three different views: a front view, a plan view, and a side view.

With reference to FIGS. 1 to 4, a stretch-forming press of the invention can be seen to comprise a frame 1 having a table 2 on which a forming die 3 is fixed. The die 3 is shown in FIG. 1 only. The die 3 is connected to a base 4 which is directly fixed to the table 2. In FIG. 1, and particularly in FIG. 2, it can be seen that the table 2 is situated at the same level as the ground 50.

Two jaws 5 and 6 extending longitudinally on either side of the die 3 are connected to the frame 1 by drive means, as described below.

Figure 3:
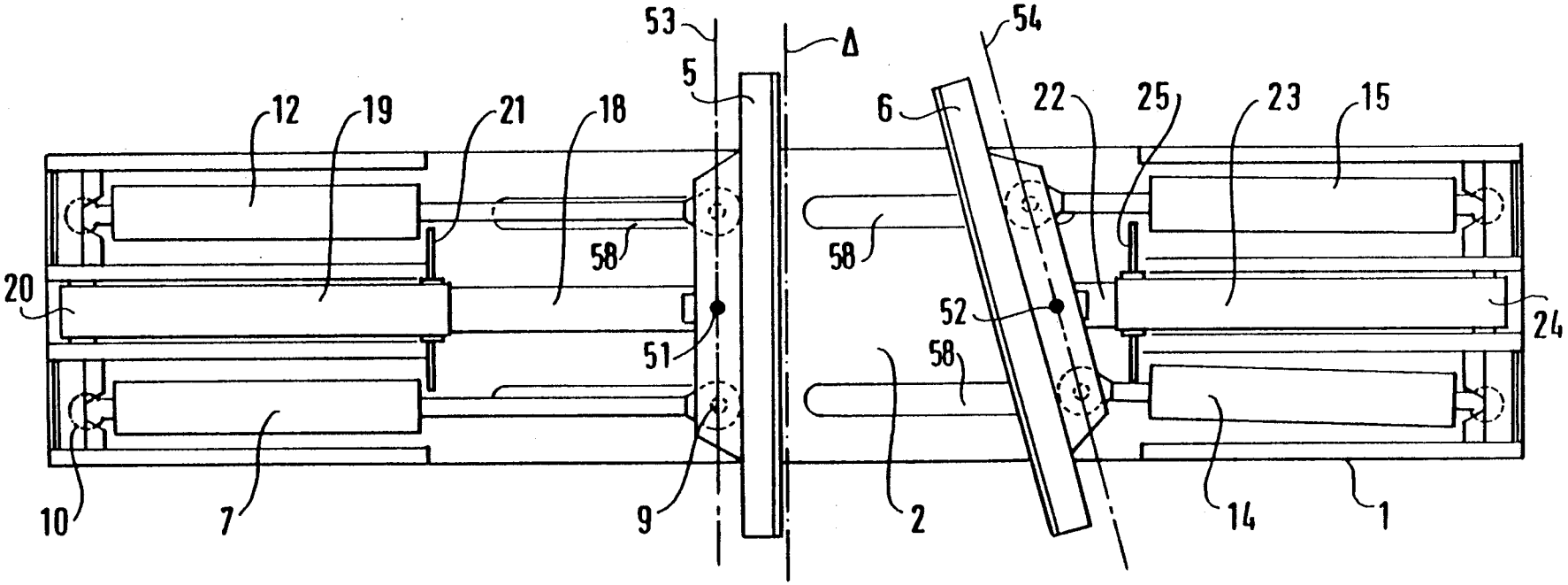
Figure 4:
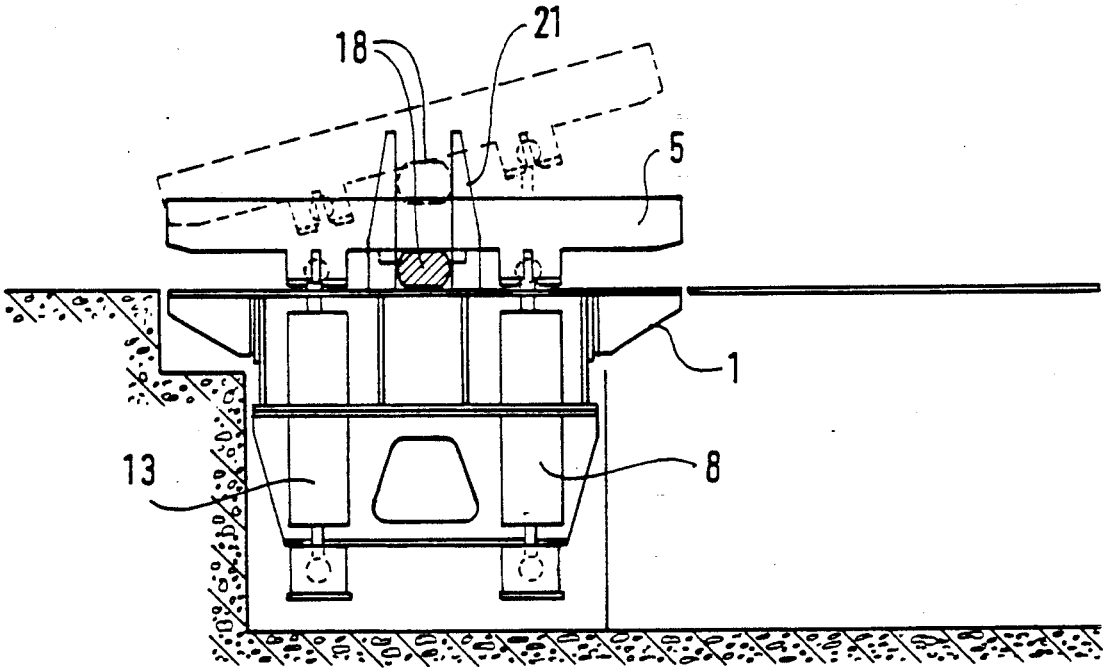

These drive means enable each end of each jaw to move substantially in a plane perpendicular to the jaw in its rest position, i.e. the position in which the jaws are parallel to the axis Δ of the table 2 (FIGS. 1 and 3).

To do this, two actuators 7 and 8 each have one end connected to a fixed point 9 close to the righthand end of the jaw 5, with the opposite ends of the actuators 7 and 8 being fixed to respective fixed points 10 and 11 on the frame 1. These two points 10 and 11 on the frame are situated in a plane perpendicular to the axis Δ and including the point 9 on the jaw 5. Similarly, the other end of the jaw 5 is driven by two actuators 12 and 13, and the jaw 6 is driven by two actuators 14 and 16 at one of its ends and two actuators 15 and 17 at its other end. The actuator 17 is not visible in the figures: it is situated behind the actuator 16 which hides it from view in FIG. 2.

The actuators are hinged at their fixing points on the frame and at their fixing points on the jaws 5 and 6.

In order to ensure that the jaws are stable, their mid-planes are constrained to move only in a fixed plane perpendicular to the axis Δ of the table 2.

To this end, the middle of the jaw 5 is connected to a guide strut comprising a rod 18 capable of sliding freely axially, and free to rotate, in a tube 19 whose end 20 pivots on the frame 1.

The front end of the tube 19 is guided by a U-shaped guide piece 21.

Similarly, the middle of the jaw 6 is connected to a rod 22 which slides in a tube 23 whose rear end 24 pivots on the frame 1.

The tube 23 is guided vertically by a U-shaped guide piece 25.

The jaws 5 and 6 are connected to the struts via the ends of the rods 18 and 22 via respective vertical axis hinges 51 and 52 (FIG. 3).

Thus, by virtue of this guidance system, the middles of the jaws 5 and 6 remain in a plane perpendicular to the axis Δ.

The system for connecting the jaws to the frame thus includes, for each jaw, four servo-controlled axes whose positions during a stretch-forming operation applied to a metal sheet are programmed so as to obtain accurate control of displacement.

As mentioned above, the ends of each jaw are displaced substantially in planes perpendicular to the axis Δ. Substantially but not exactly, given that the centers of the jaws are constrained by the guide pieces 21 and 25 to move in a fixed plane perpendicular to Δ, with the result that once the jaw itself is no longer displaced parallel to the axis Δ, an end of a jaw, e.g. the point 9 at the righthand end of the jaw 5, does not remain in the plane perpendicular to Δ and including the hinge points 10 and 11 of the actuators.

Each of the ends of the sheet to be stretched is clamped in a corresponding one of the jaws 5 and 6. A sheet 26 can be seen in FIG. 1.

As can be seen in the figures, the jaws 5 and 6 are connected to the actuators and to the struts via vertical axis hinges and they can also pivot about the axes of the rods 18 and 22 of the struts, however they cannot pivot in any manner relative to their connection points about their longitudinal axes, 53 for the jaw 5 or 54 for the jaw 6 (FIG. 3).

Thus, during stretching, the jaws are subjected to a reaction torque which is opposed by the struts that are large in size. The torque is thus transmitted to the frame.

Figure 8:
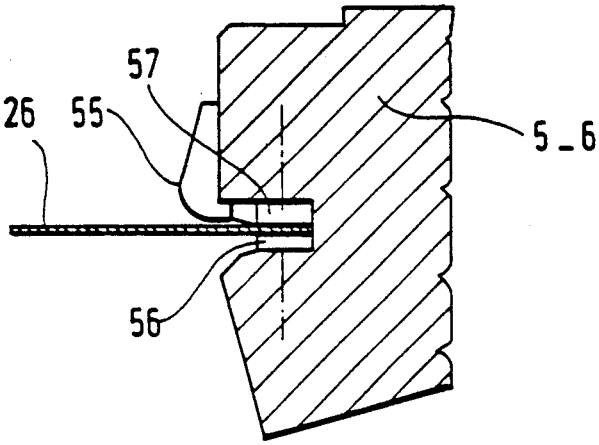
FIG. 8 is a section through a detail of a jaw.

FIG. 8 is a detail showing a section through a jaw 5 or 6 carrying a curved forming tip 55 at the outlet from upper and lower jaws 56 and 57. This forming tip allows the sheet 26 to be wound against the jaws. The presence of this tip and of the guide and reaction strut make it possible to wind the sheet 26 on the forming tool 3 through as much as 240°, and also makes it possible for the two tips to come extremely close together so that they are almost touching, as may be required for forming very narrow leading edges of aircraft wings: e.g. that are only 20 mm across.

Figure 5:
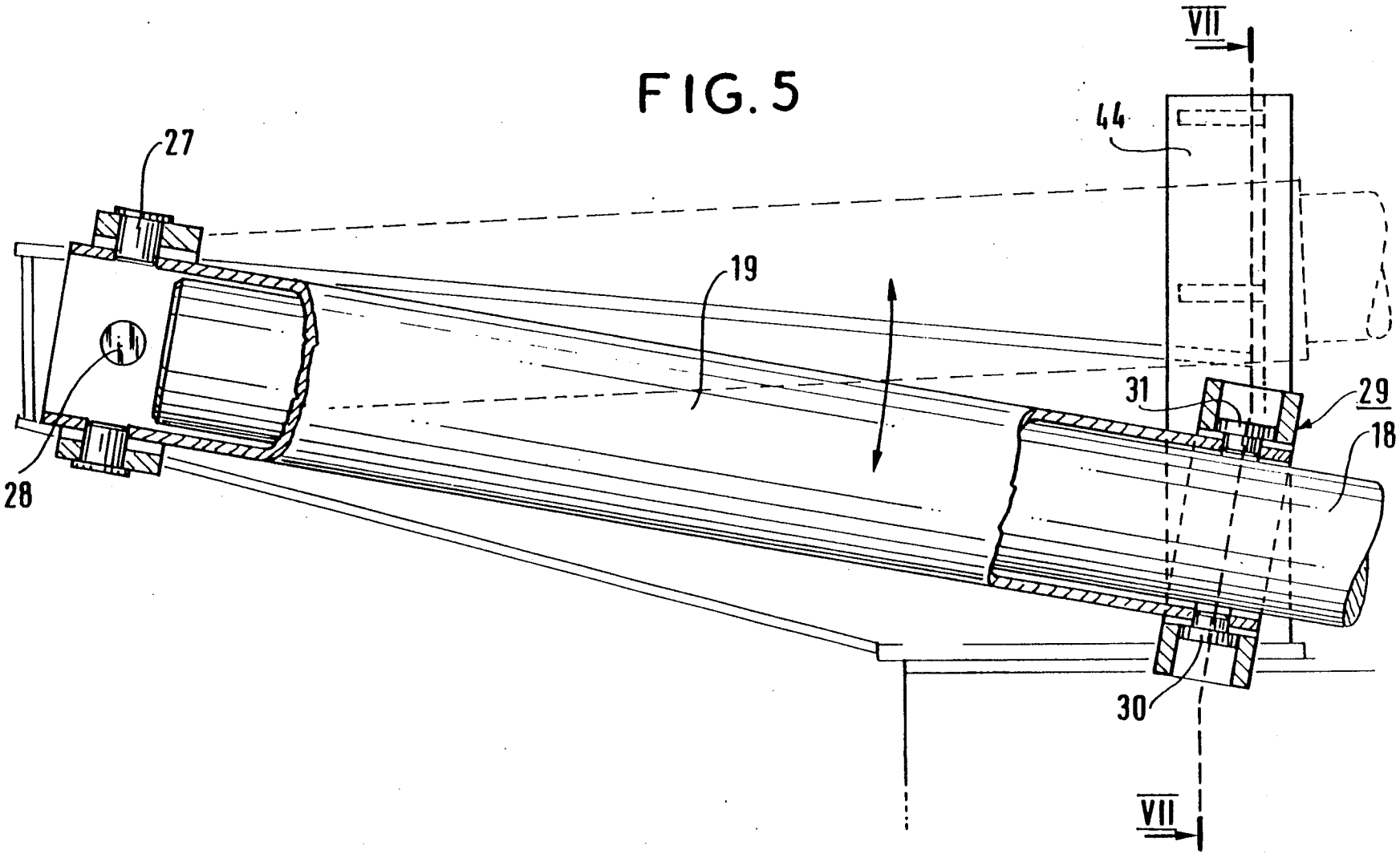
FIG. 5 is a front view showing a detail of a guide strut for guiding the midplane of a jaw in a variant embodiment of the invention where the jaws are capable of moving lengthwise.
Figure 6:
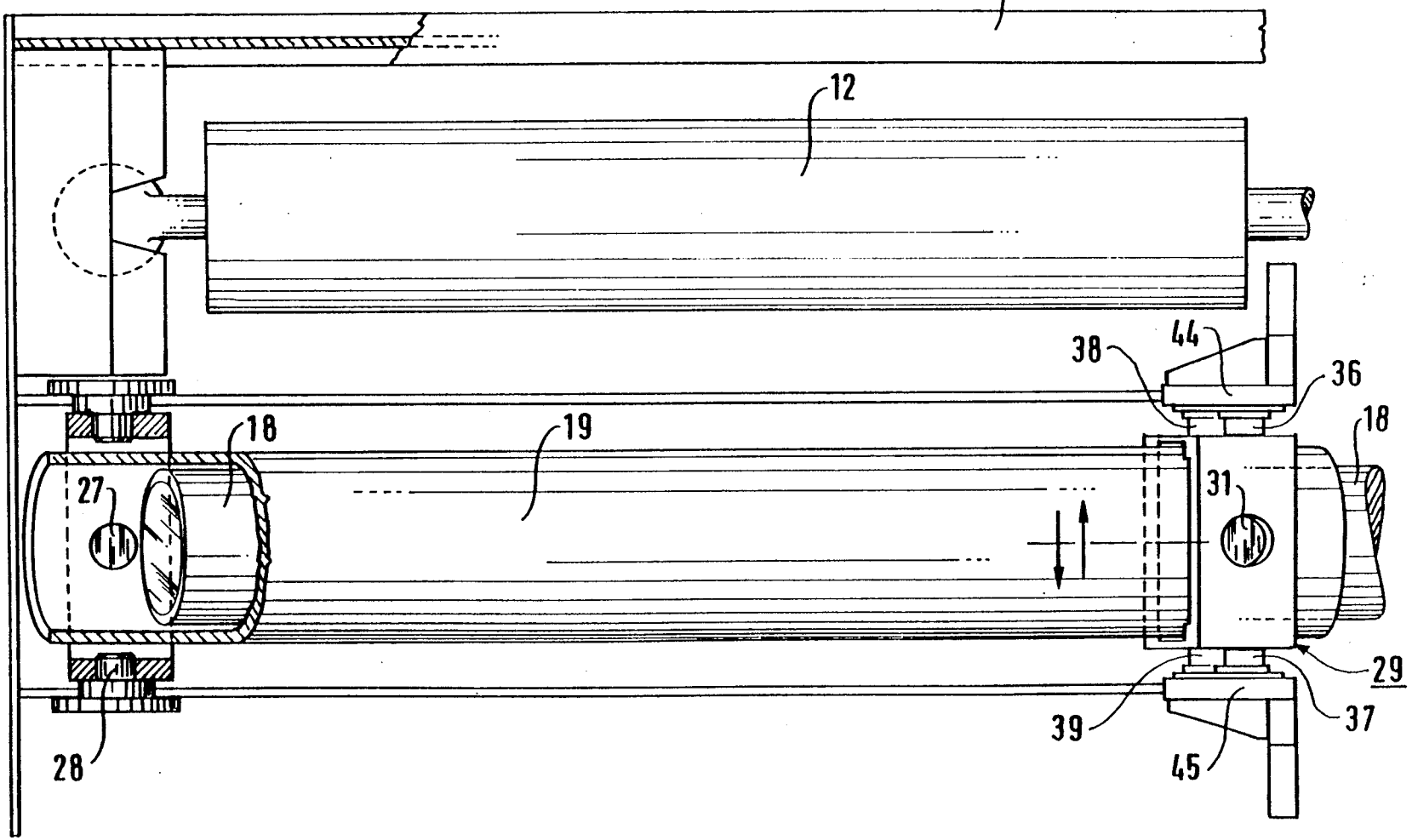
FIG. 6 shows the strut of FIG. 5 seen from above.
Figure 7:
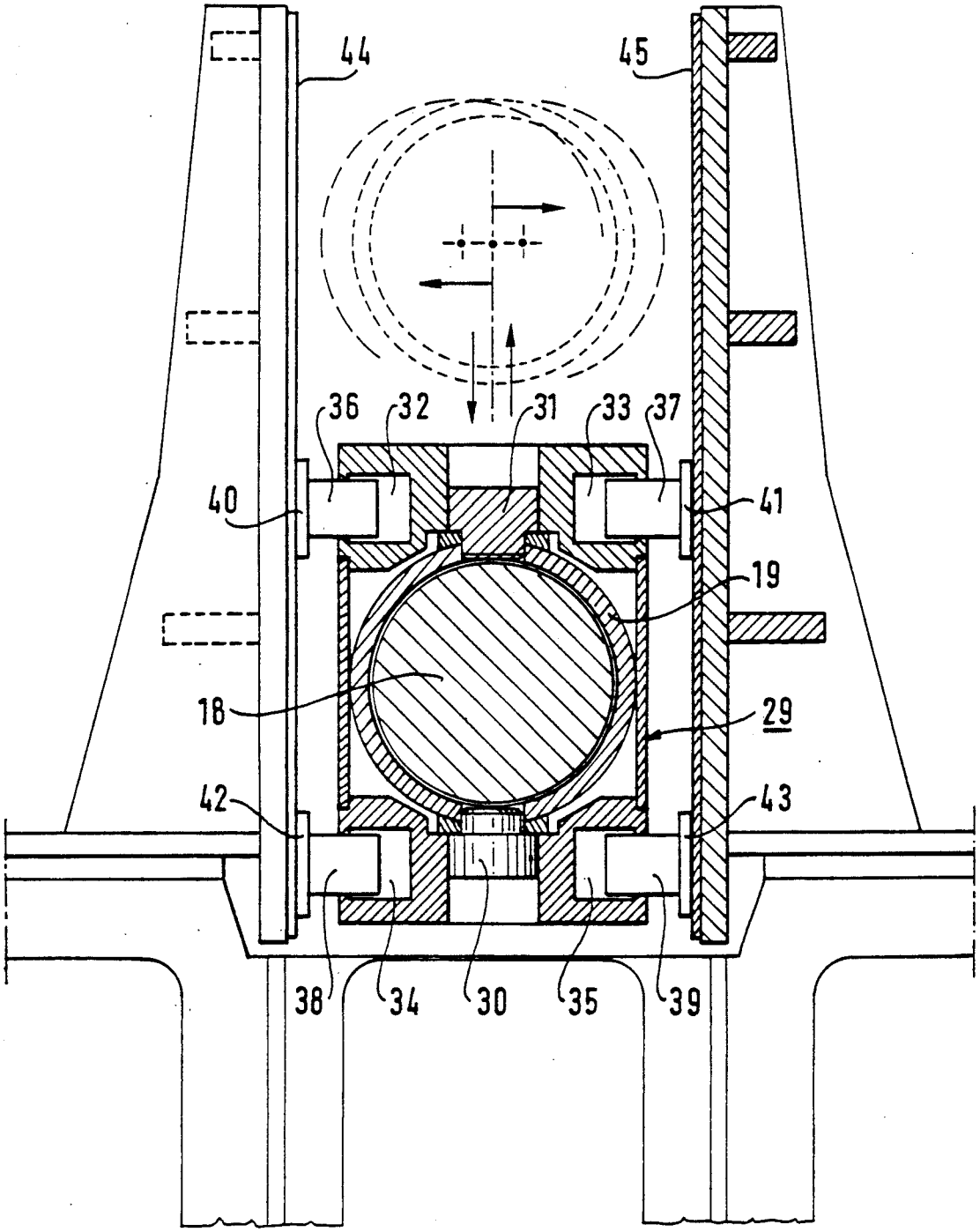
FIG. 7 is a section on VII—VII of FIG. 5.

FIGS. 5, 6, and 7 show a variant of the invention in which an additional servo-control axis is provided for each jaw enabling each jaw to move along its longitudinal axis.

To this end, the guide strut 18, 19 is hinged at its rear end via its tube 19 about two perpendicular axes 27 and 28.

The front end of the tube 19 has a central guide nut 29 mounted thereon and capable of pivoting about a substantially vertical axis by virtue of stub axles 30 and 31. This central guide nut 29 includes four actuator cylinders 32, 33, 34, and 35 whose pistons 36, 37, 38, and 39 carry skids 40 to 43 which slide on fixed vertical guide walls 44 and 45.

Thus, using this system, the guide strut 18, 19 may be displaced a small amount angularly enabling servo-controlled displacement of the jaws along their own longitudinal axes. This additional motion is advantageous, particularly when forming on conical dies, since it makes it possible to avoid excessive elongation and the forming of folds.

The same longitudinal motion may also be obtained by actuators hinged between the guide tubes 19 and 20 and the frame 1 of the machine; these actuators act in a plane perpendicular to the axis of the guide tubes 19 and 20 and in a substantially horizontal direction.

Another solution consists in hinging these actuators between the jaws 5 and 6 and the frame 1 of the machine in such a manner as to establish a stable three-dimensional triangulation with the frame 1 of the machine and each of the two main groups of actuators 7, 8, 12, 13, and 14, 15, 16, and 17.

As can be seen in FIGS. 1 and 3, the actuator rods pass through the table 2 of the frame 1 via simple slots 58. These slots may be closed by a sliding curtain system lying flush with the top plane of the table 2. This ensures that operators are in no danger of falling.

I claim:

1. A stretch-forming machine for forming a sheet about an elongated forming die, said machine comprising: a pair of jaws extending respectively longitudinally along opposite sides of said die for grasping a respective opposite edge of the sheet, said machine including a base having a fixed frame, drive means having one end connected to said fixed frame and a second end connected to each jaw for causing the end of the jaw proximate to said forming die to move substantially in a plane perpendicular to a longitudinal axis of the jaw in its rest position and to move said jaw in any direction within said plane, said die being fixed to said base and connected to a table on said fixed frame, said table being situated at ground level, and said die being mounted on said table and having a longitudinal axis extending horizontally, and said machine further including vertical guide means on said fixed frame operatively coupled to the longitudinal center of the jaws for limiting movement of the jaws vertically and perpendicular to the axis of said die, and wherein said means for connecting said jaws to respective drive means comprises means for preventing rotation of said jaws relative to said drive means about a longitudinal axis parallel to the longitudinal axis of the forming die.

2. A machine according to claim 1, further comprising means for displacing said vertical guide means laterally in the lengthwise direction of the jaws.

3. A machine according to claim 1, wherein said vertical guide means comprise, for each jaw, a guide strut comprising a tube pivoted at a rear end thereof to said frame for pivoting about a horizontal axis parallel to the axis of the forming die, and a rod pivotally coupled at one end to the middle of the jaw for pivoting about a vertical axis, said rod having an opposite end slidably and rotatably positioned within said hollow tube, and wherein said vertical guide means further comprises a U-shaped guide piece fixedly mounted to said frame, extending upwardly therefrom, and wherein said front end of said guide strut tube is positioned within said U-shaped guide piece.

4. A machine according to claim 2, wherein said laterally displaceable vertical guide means comprise, for each jaw, a guide strut constituted by a rod fixed to the middle of the jaw by means of a vertical axis hinge and sliding freely, with freedom to rotate in a tube, and said hinge pivoting said tube about two perpendicular axes with a front end thereof carrying a guide nut, and wherein said vertical guide means includes a U-shaped guide piece fixed to said frame and having vertical guide walls, a plurality of horizontal side actuators on opposite sides of said tube front end, terminating in skids which slidably contact with the guide walls, whereby the lateral position of the front end of said tube may be shifted by selective actuation of said horizontal side actuators.

5. A machine according to claim 1, wherein said drive means comprise, for each jaw and for each end of a jaw, two means for varying the distance between a fixed point of the jaw adjacent to said respective ends of the jaw, and two fixed points on the frame, and wherein said two fixed points on said frame being two distinct points situated in a plane including said fixed point of the jaw, and extending transversely to the jaw when in a first position thereof.

6. A machine according to claim 1, wherein each jaw includes a curve-forming tip proximate to a side of the jaw gripping a longitudinal edge of said sheet to be formed and above the sheet to be formed.

7. A machine according to claim 4, wherein said guide nut comprises a pair of generally vertically aligned stub axles, pivotally mounting the front end of said guide tube for permitting the front end of the guide tube to pivot slightly within the guide nut while supported for movement in a generally vertical plane within said U-shaped guide piece.

* * * * *